US008559844B2

(12) United States Patent
Ochi

(10) Patent No.: US 8,559,844 B2
(45) Date of Patent: Oct. 15, 2013

(54) ELECTROSTATIC IMAGE FORMING APPARATUS UTILIZING DUAL CHARGERS TO CLEAN TRANSFER BELT

(75) Inventor: Junichi Ochi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 331 days.

(21) Appl. No.: 13/006,852

(22) Filed: Jan. 14, 2011

(65) Prior Publication Data

US 2011/0176824 A1 Jul. 21, 2011

(30) Foreign Application Priority Data

Jan. 18, 2010 (JP) ..... 2010-008360

(51) Int. Cl.
*G03G 15/16* (2006.01)

(52) U.S. Cl.
USPC ..... 399/101

(58) Field of Classification Search
USPC ..... 399/66, 98, 129, 308, 101
See application file for complete search history.

(56) References Cited

U.S. PATENT DOCUMENTS

| | | | | |
|---|---|---|---|---|
| 7,113,713 | B2 * | 9/2006 | Soda et al. | 399/66 |
| 7,190,919 | B2 * | 3/2007 | Kitagawa | 399/101 |
| 7,215,920 | B2 * | 5/2007 | Shida | 399/101 X |
| 7,251,430 | B2 * | 7/2007 | Nishikawa | 399/101 |
| 7,395,004 | B2 * | 7/2008 | Nishikawa | 399/101 X |
| 7,433,626 | B2 * | 10/2008 | Takeuchi | 399/101 |
| 2005/0232667 | A1 * | 10/2005 | Iwata | 399/353 |
| 2008/0187352 | A1 * | 8/2008 | Takeuchi | 399/101 |

FOREIGN PATENT DOCUMENTS

| | | |
|---|---|---|
| JP | 2003-057855 A | 2/2003 |
| JP | 2004-093635 A | 3/2004 |
| JP | 2005-338785 A | 12/2005 |
| JP | 2006-343508 A | 12/2006 |

* cited by examiner

*Primary Examiner* — Sandra Brase
(74) *Attorney, Agent, or Firm* — Fitzpatrick, Cella, Harper & Scinto

(57) ABSTRACT

An image forming apparatus includes a photosensitive member, an intermediary transfer belt, a first charging device and a second charging device. Residual toner remaining on the intermediary transfer belt is to be electrically charged by the first and second charging devices and then is to be collected by being moved from the intermediary transfer belt to the photosensitive member. The first and second charging devices are successively contacted to the intermediary transfer belt at a determined timing, beginning with the first charging device disposed on an upstream side, thus electrically charging the residual toner. Thereafter, the first and second charging devices are successively spaced from the intermediary transfer belt at a determined timing, beginning with the first charging device.

12 Claims, 7 Drawing Sheets

(a)

(b)

(c)

ELECTROSTATIC IMAGE FORMING APPARATUS UTILIZING DUAL CHARGERS TO CLEAN TRANSFER BELT

FIELD OF THE INVENTION AND RELATED ART

The present invention relates to image forming apparatuses such as copying machines and laser printers.

A color image forming apparatus using an intermediary transfer belt as an intermediary transfer member has been conventionally used. In this image forming apparatus, toner images of yellow (Y), magenta (M), cyan (C) and black (BK) are successively primary-transferred and superposed on the rotating intermediary transfer belt. Thereafter, the superposed toner images are collectively secondary-transferred from the intermediary transfer belt onto a transfer material. Then, the secondary-transferred toner images are fixed on the transfer material.

In the image forming apparatus of this type, there is a need to collect residual toner remaining on the intermediary transfer belt without being secondary-transferred on the transfer material after completion of the secondary transfer. As a method of collecting the residual toner, there is a method in which the residual toner on the intermediary transfer belt is electrically charged by a charging device contacting an outer surface of the intermediary transfer belt and then the charged residual toner is transferred on an image bearing member in a residual toner nip to be collected by a collecting device for the image bearing member. In order enhance a charge imparting efficiency with respect to the residual toner by the charging device, a plurality of charging devices are used in some cases. Japanese Laid-Open Patent Application (JP-A) 2004-93635 discloses a technique in which two roller charging devices are contacted to and separated from the intermediary transfer belt while providing a time difference.

Incidentally, when a main assembly of the image forming apparatus is downsized, a circumferential length of the intermediary transfer belt is required to be decreased. Here, on the intermediary transfer belt, the toner images are transferred and superposed through one full circumference and therefore the intermediary transfer belt includes an image transfer area in which the toner images can be primary-transferred and a non-image transfer area in which the toner images are not transferred. In the non-image transfer area, switching of a developing device or the like is performed. In the case where there was a need to move the charging device, for charging the residual toner on the intermediary transfer belt, toward and away from the intermediary transfer belt the charging device has been conventionally moved toward and away from the intermediary transfer belt with timing when the charging device opposed the non-image transfer area on the intermediary transfer belt. However, as the circumferential length of the intermediary transfer belt becomes shorter, a length of the non-image transfer area on the intermediary transfer belt with respect to a rotational direction of the intermediary transfer belt becomes shorter. For this reason, it is difficult to move all of the plurality of charging devices, disposed at predetermined intervals, toward and away from the intermediary transfer belt in the non-image transfer area on the intermediary transfer belt.

SUMMARY OF THE INVENTION

A principal object of the present invention is to provide an image forming apparatus in which a plurality of charging devices is moved toward and away from an intermediary transfer member with reliability with timing when the charging devices oppose a non-image transfer area even when a circumferential length of the intermediary transfer member is shortened.

According to an aspect of the present invention, there is provided an image forming apparatus comprising:

an image bearing member for bearing a toner image;

a rotatable intermediary transfer member;

a primary transfer device, which forms a primary transfer nip between the image bearing member and the intermediary transfer member, for primary-transferring the toner image from the image bearing member into the intermediary transfer member in the primary transfer nip;

a collecting device for collecting the toner on the image bearing member;

a secondary transfer device for secondary-transferring the toner image from the intermediary transfer member onto a transfer material;

a first charging device, movable between a first contact position in which the first charging device is contacted to the intermediary transfer member and a first separation position in which the first charging device is separated from the intermediary transfer member, for electrically charging residual toner remaining on the intermediary transfer member at the contact position;

a second charging device, movable between a second contact position in which the second charging device is contacted to the intermediary transfer member and a second separation position in which the second charging device is separated from the intermediary transfer member, for electrically charging the residual toner remaining on the intermediary transfer member at the contact position, wherein the second charging device is provided downstream of the first charging device with respect to a rotational direction of the intermediary transfer member; and a switching unit for switching positions of the first charging device relative to the intermediary transfer member and positions of the second charging device relative to the intermediary transfer member, wherein the image forming apparatus is capable of executing a collecting mode in which the residual toner electrically charged by the first and second charging devices is moved from the intermediary transfer member to the image bearing member in the primary transfer nip and then is collected by the collecting device, wherein the switching unit moves, when the first and second charging devices are moved from the first and second separation positions to the first and second contact positions, the first charging device from the first separation position to the first contact position with timing when the first charging device opposes a non-image transfer area adjacent to an image transfer area and then moves the second charging device from the second separation position to the second contact position with timing when the second charging device opposes the non-image transfer area, and wherein the switching unit moves, when the first and second charging devices are moved from the first and second contact positions to the first and second separation positions, the first charging device from the first contact position to the first separation position with timing when the first charging device opposes the non-image transfer area and then moves the second charging device from the second contact position to the second separation position with timing when the second charging device opposes the non-image transfer area.

These and other objects, features and advantages of the present invention will become more apparent upon a consideration of the following description of the preferred embodiments of the present invention taken in conjunction with the accompanying drawings.

Figure 2:
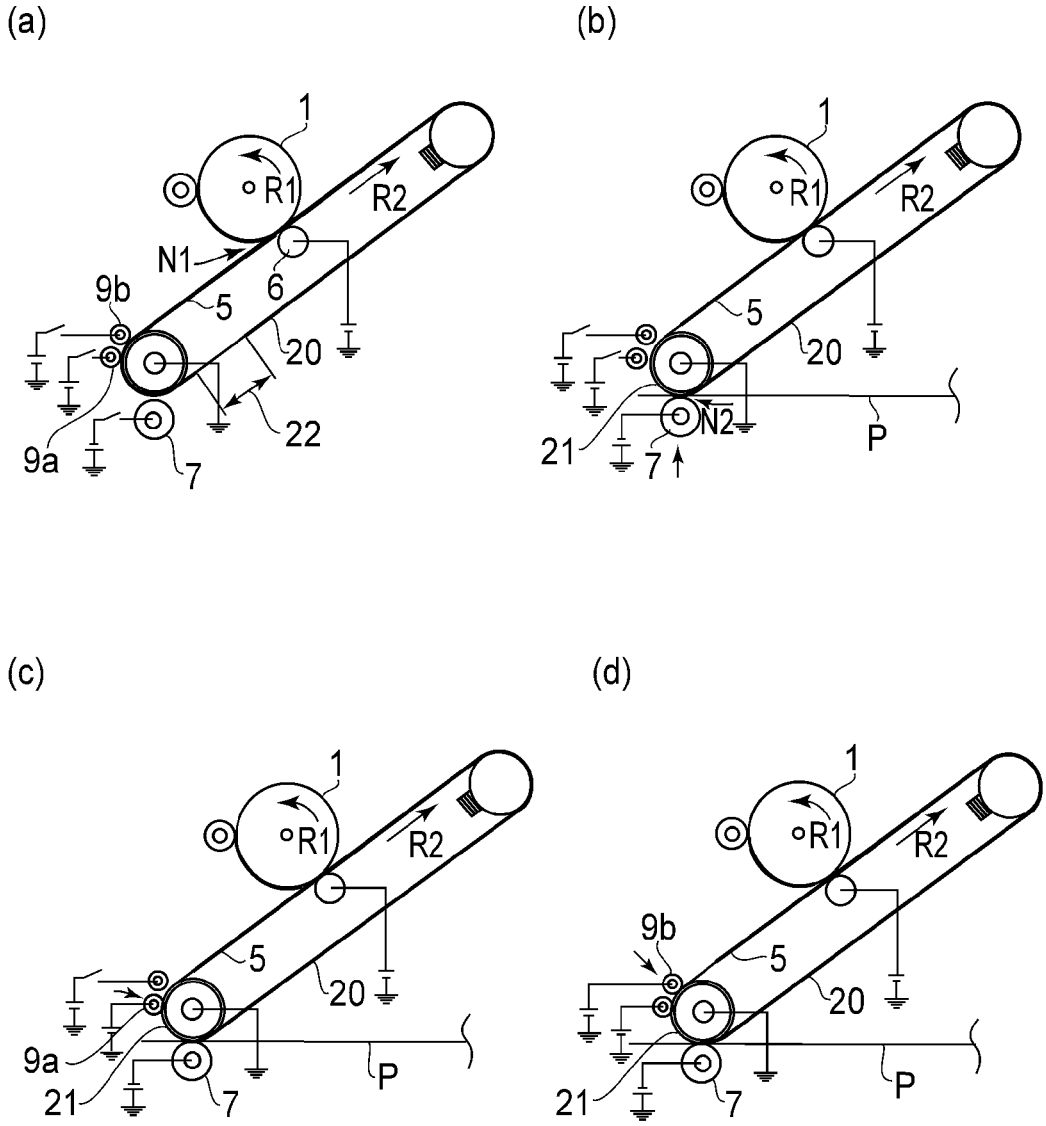

Parts (a) to (d) of FIG. 2 are schematic views for illustrating contact timing of charging devices in First Embodiment.

Figure 3:
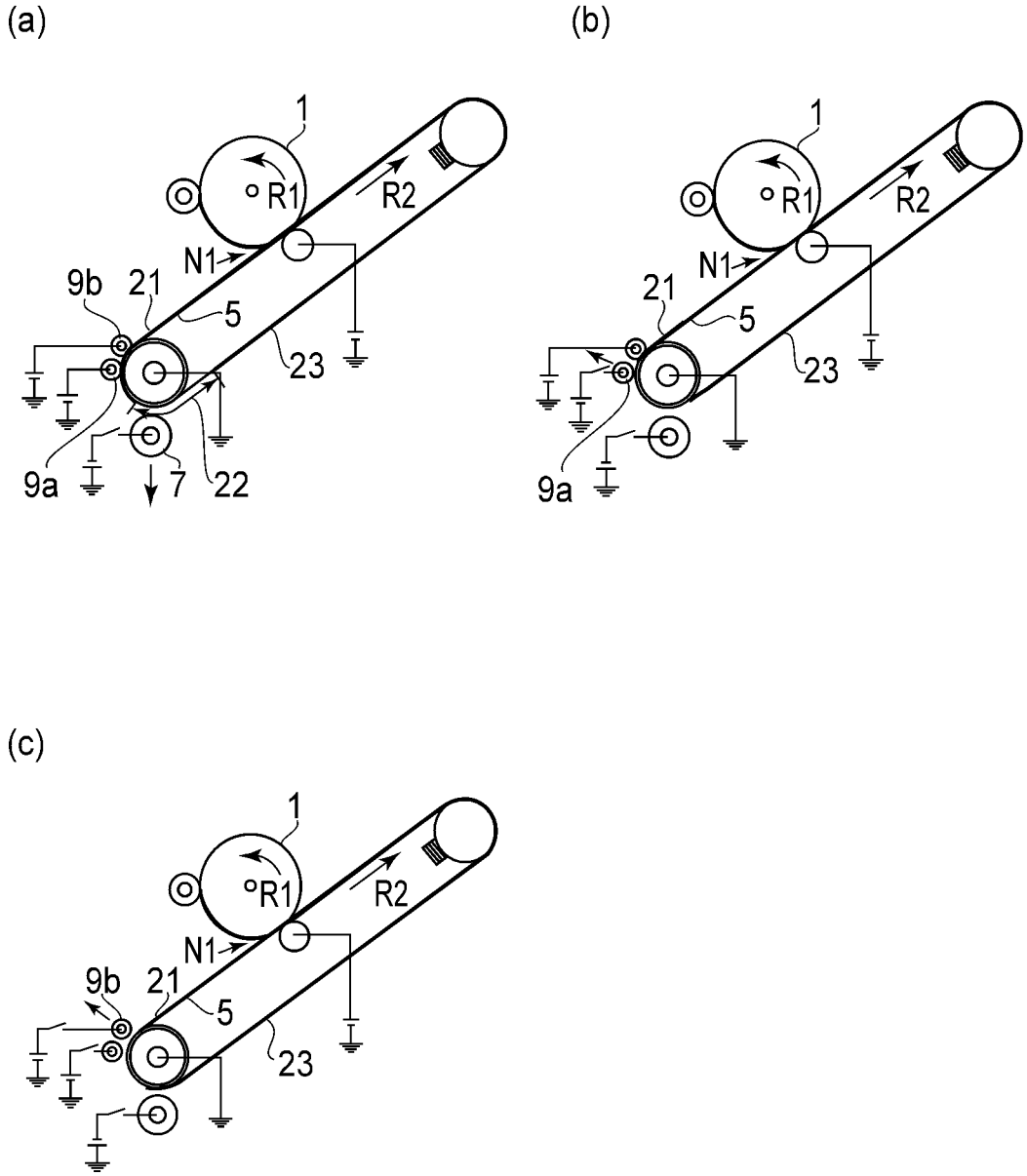

Parts (a) to (c) of FIG. 3 are schematic views for illustrating separation timing of the charging devices in First Embodiment.

Figure 4:
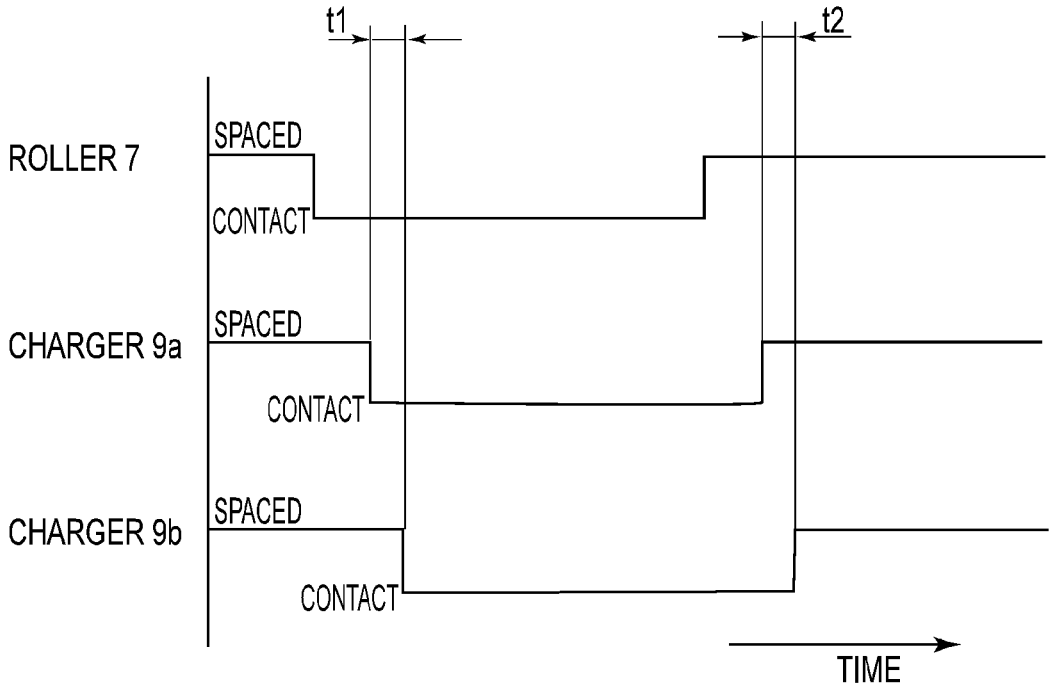

FIG. 4 is a timing chart of contact and separation of the charging devices in First Embodiment.

Figure 5:
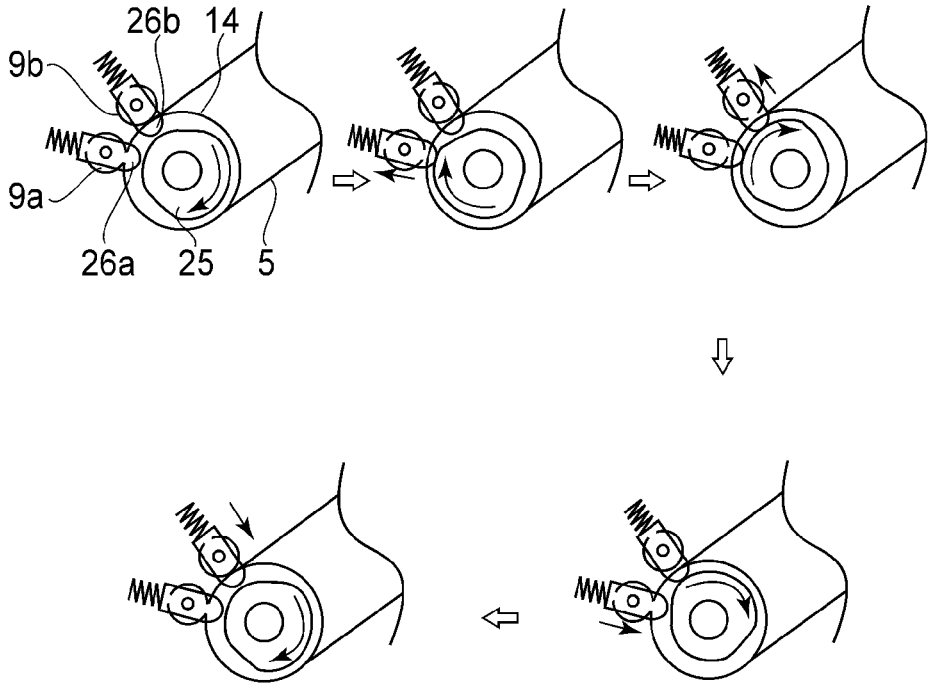

FIG. 5 is a schematic view for illustrating an operation of a switching unit in First Embodiment.

Figure 6:
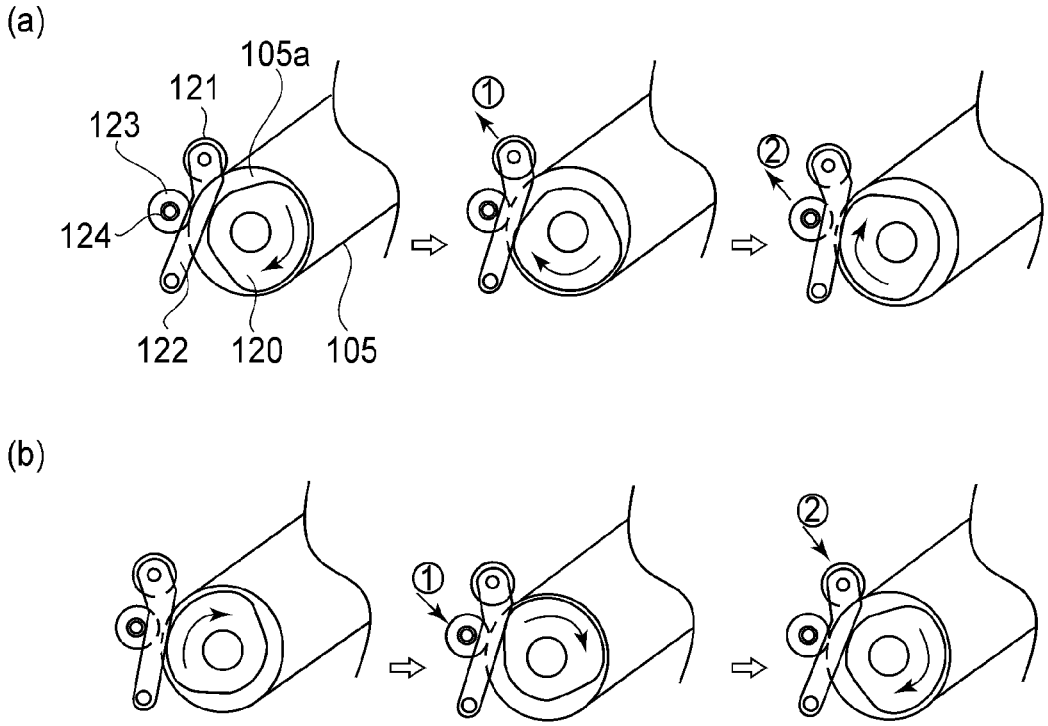

Parts (a) and (b) of FIG. 6 are schematic views for illustrating an operation of a switching unit in a comparative embodiment.

Figure 7:
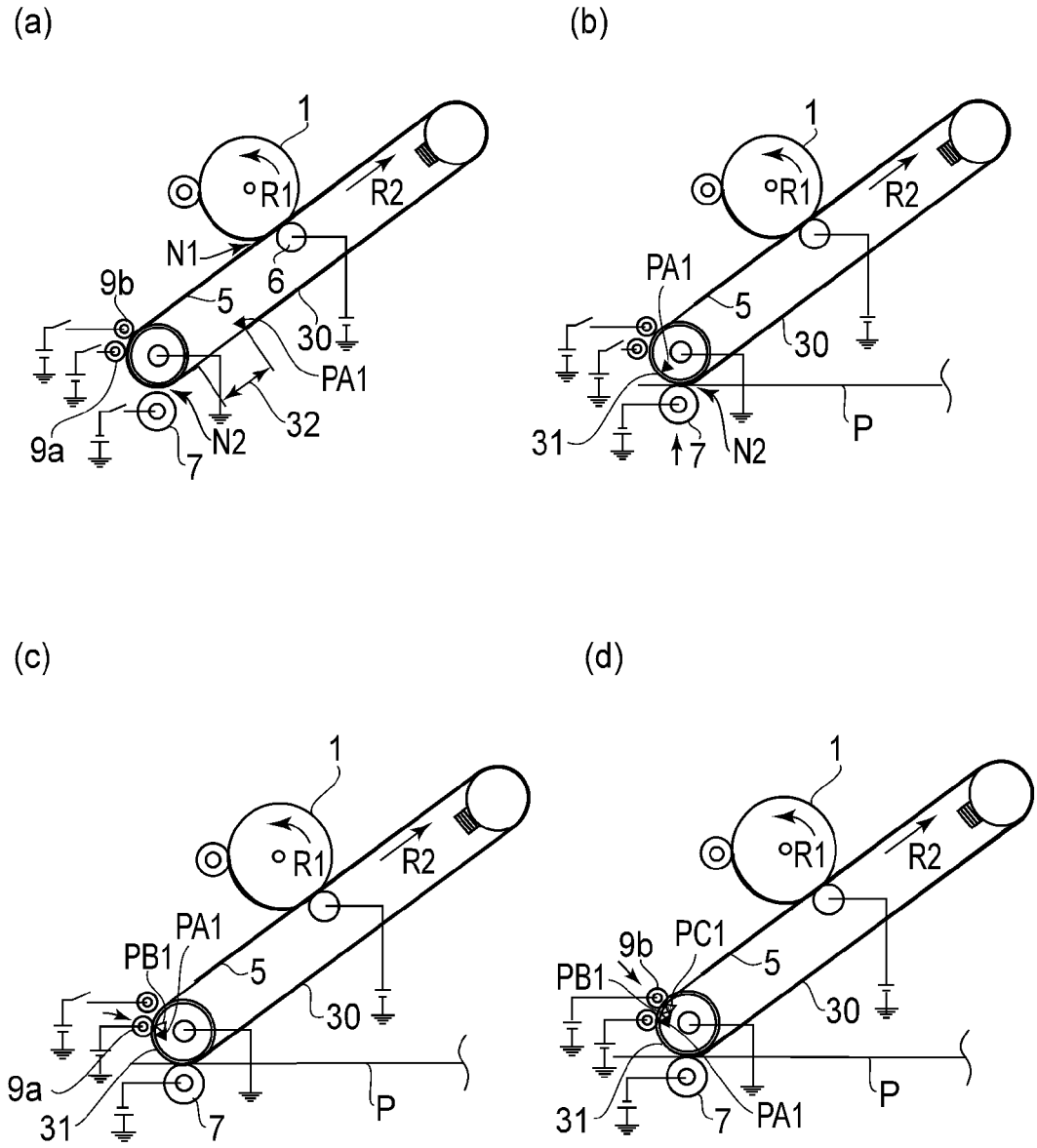

Parts (a) to (d) of FIG. 7 are schematic views for illustrating contact timing of charging devices in Second Embodiment.

Figure 8:
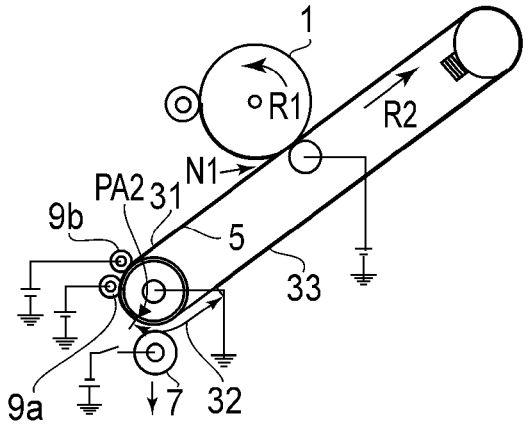
Figure 8:
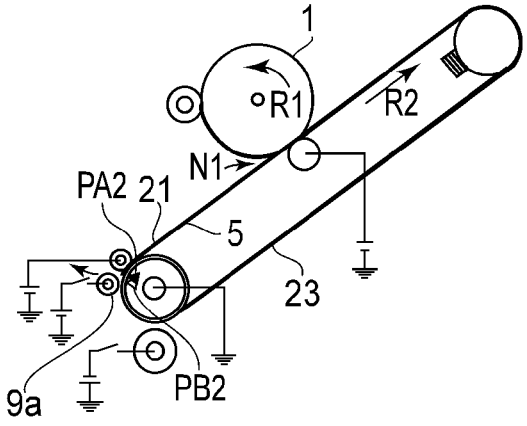
Figure 8:
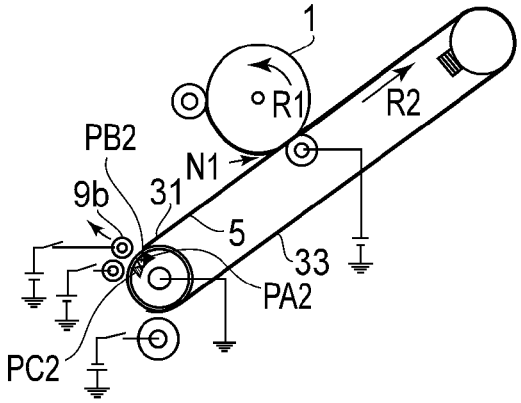

Parts (a) to (c) of FIG. 8 are schematic views for illustrating separation timing of the charging devices in Second Embodiment.

Figure 9:
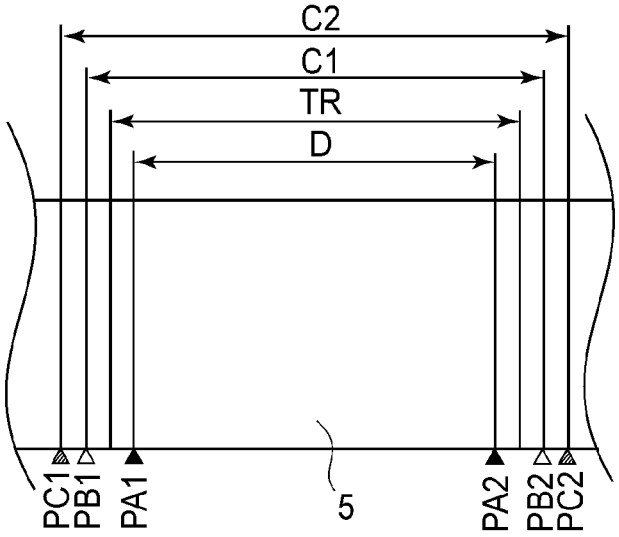

FIG. 9 is a schematic view for illustrating a total area during contact of the charging devices in Second Embodiment.

DESCRIPTION OF THE PREFERRED EMBODIMENTS

Hereinbelow, embodiments for carrying out the present invention will be specifically described with reference to the drawings. However, with respect to dimensions, materials, shapes, relative arrangements and the like of constituent elements described in the following embodiments, the scope of the present invention is not limited thereto unless otherwise specified.

First Embodiment

Figure 1:
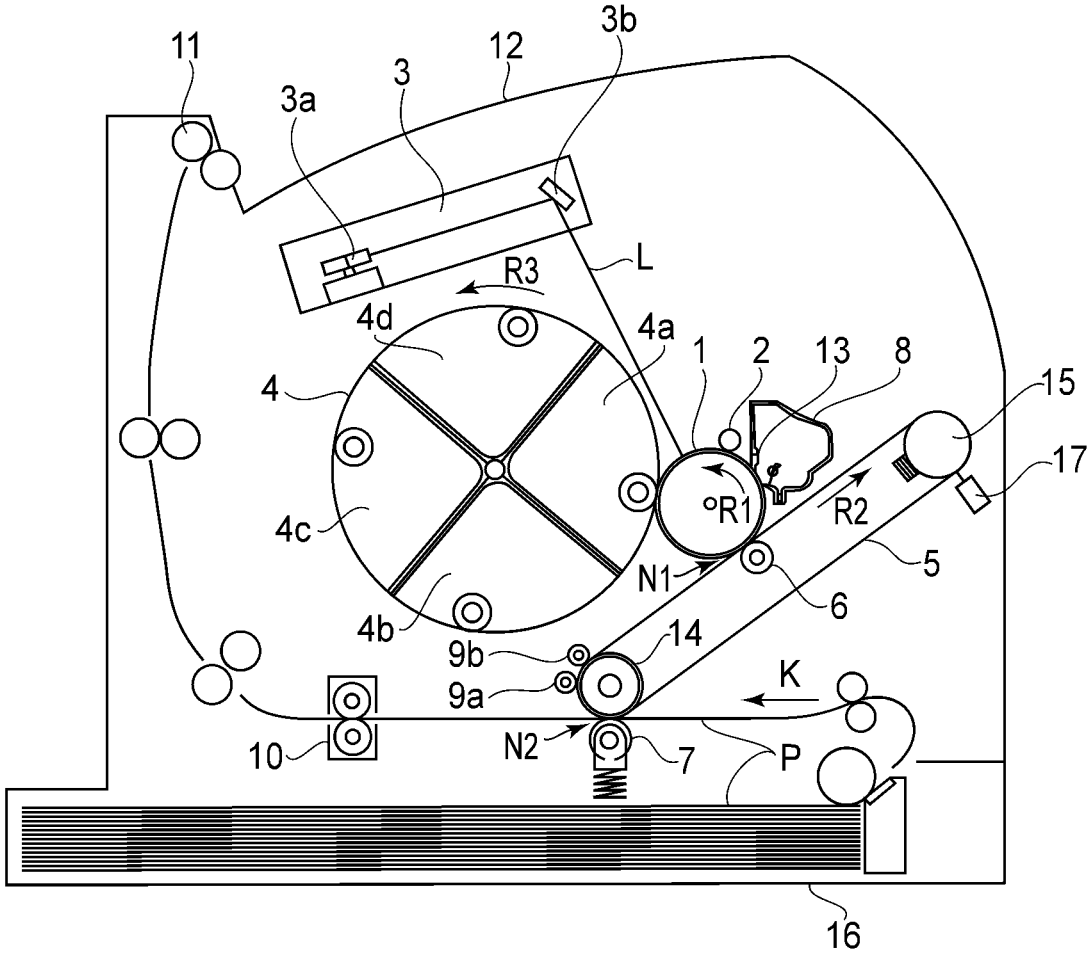
FIG. 1 is a schematic illustration of an image forming apparatus in Embodiment 1.

FIG. 1 is a schematic illustration of an image forming apparatus in this embodiment. The image forming apparatus shown in FIG. 1 is a full-color laser beam printer of an electrophotographic type in which an intermediary transfer belt is used as an intermediary transfer member.

The image forming apparatus includes a drum-type electrophotographic photosensitive member (hereinafter referred to as a photosensitive drum) 1 as an image bearing member. The photosensitive drum 1 is constituted by providing an electroconductive layer on an outer peripheral surface of an aluminum cylinder. The photosensitive drum 1 is rotatably supported by a main assembly of the image forming apparatus (hereinafter referred to as an apparatus main assembly) and is rotationally driven in a direction indicated by an arrow R1 by an unshown driving unit. A charging roller 2, an exposure unit 3, a developing unit 4, an intermediary transfer belt 5, a photosensitive drum cleaning blade 13 and a residual toner container 8 are disposed at a periphery of the photosensitive drum 1.

The charging roller 2 is a charging roller for the image bearing member and charges the surface of the photosensitive 1 uniformly. The exposure unit 3 includes a laser oscillator (not shown) for emitting laser light L depending on image information, and a polygon mirror 3*a* and a mirror 3*b* as devices for scanning the surface of the photosensitive drum 1 with the laser light L. The exposure unit 3 irradiates the surface of the photosensitive drum 1 with the laser light L depending on the image information, thus forming an electrostatic latent image on the charged surface of the photosensitive drum 1. The developing unit 4 is a rotatable developing unit which is called a rotary unit and to which developing devices 4*a* to 4*d* of yellow, magenta, cyan and black, each for developing the electrostatic latent image into a toner image by depositing associated toner on the latent image. Onto the intermediary transfer belt 5, the toner image on the photosensitive drum 1 is primary-transferred. The photosensitive drum cleaning blade 13 removes residual toner remaining on the surface of the photosensitive drum 1. The residual toner container 8 contains the residual toner removed by the photosensitive drum cleaning blade 13. The photosensitive drum cleaning blade 13 and the residual toner container 8 constitute a collecting device.

Here, the intermediary transfer belt 5 is an endless belt and is stretched between a driving roller 14 and a tension roller 15, thus being rotatable. The driving roller 14 and the tension roller 15 are stretching rollers.

The intermediary transfer belt 5 is rotated in a direction indicated by an arrow R2 by rotating the driving roller 14 by an unshown driving means. Inside the intermediary transfer belt 5, a primary transfer roller 6 as a primary transfer device is disposed and urges the intermediary transfer belt 5 against the surface of the photosensitive drum 1 by an unshown urging means, so that a primary transfer nip N1 is formed between the photosensitive drum 1 and the intermediary transfer belt 5. To the primary transfer roller 6, a primary transfer voltage is applied from an unshown power source.

Outside the intermediary transfer belt 5, a secondary transfer roller 7 as a secondary transfer device is disposed, so that a secondary transfer nip N2 is formed between the intermediary transfer belt 5 and the secondary transfer roller 7. The secondary transfer nip N2 is located downstream of the primary transfer nip N1 with respect to the rotational direction of the intermediary transfer belt 5 (hereinafter, the rotational direction of the intermediary transfer belt 5 will be sometimes omitted). To the secondary transfer roller 7, a secondary transfer voltage is applied from an unshown power source. At positions on a downstream side of the secondary transfer nip N2 and on an upstream side of the primary transfer nip N1, a plurality of charging devices 9*a* and 9*b* are disposed as a part of an intermediary transfer belt cleaning unit so as to oppose the intermediary transfer belt 5. Each of the charging devices 9*a* and 9*b* is movable between a contact position in which the associated charging device is contacted to the intermediary transfer belt 5 and a separation position in which the associated charging device is completely separated from the intermediary transfer belt 5. The charging devices in this embodiment are roller chargers 9*a* and 9*b*, each of which has a roller shape. Each charging device is movable between the contact position and the separation position by a switching unit.

The roller chargers 9*a* and 9*d* charge the residual toner, remaining on the intermediary transfer belt 5*a* after the secondary transfer, during the contact with the intermediary transfer belt 5. The roller chargers 9*a* and 9*b* are each a roller member having a predetermined resistance value. Incidentally, in place of the rollers, brushes or a sheet member may also be used. Further, the number of the charging devices may also be three or more.

Further, on the downstream side of the secondary transfer nip N2 with respect to a conveyance direction (indicated by an arrow K) of a transfer material P fed and conveyed from a sheet feeding cassette 16, a fixing device 10 for fixing the toner image transferred on the transfer material P by heating and pressing the toner image is disposed. Incidentally, as the transfer material P, a recording material such as paper, a print sheet, a transfer sheet, an OHP sheet, glossy paper, a glossy film, electrofax paper or electrostatic recording paper may be used.

Next, an image forming process will be described. The photosensitive drum 1 rotationally driven in the arrow R1 direction is charged uniformly at its surface by applying to the charging roller 2 a charging voltage in the form of superposed voltages between a DC voltage and an AC voltage. On the other hand, a toner patch which is a test toner image formed on the intermediary transfer belt 5 is read by a test pattern detecting device 17 to determine image writing timing and then an image signal for yellow is inputted into the unshown oscillator. As a result, the laser light L is emitted and the charged surface of the photosensitive drum 1 is irradiated with the laser light L, so that the electrostatic latent image is formed. When the photosensitive drum 1 is further rotated, on the electrostatic latent image on the photosensitive drum 1, yellow toner is deposited by the yellow developing device 4*a*, so that the electrostatic latent image is developed into a yellow toner image. The yellow toner image on the photosensitive drum 1 (the image bearing member) is primary-transferred onto the intermediary transfer belt 5 (the intermediary transfer member) through the primary transfer nip N1 by the primary transfer voltage applied to the primary transfer roller 6.

The photosensitive drum 1 after the toner image transfer is subjected to removal of the residual toner from its surface by the photosensitive drum cleaning blade 13 and then is subjected to subsequent image formation. The removed residual toner is collected in the residual toner container 8. A series of image forming processes including the charging, the exposure, the development, the primary transfer and the cleaning described above are repeated also with respect to other three colors, i.e., magenta, cyan and black.

When the image forming processes are performed, timing of each primary transfer is properly adjusted, so that four color toner images superposed on the intermediary transfer belt 5 are formed on the intermediary transfer belt 5. The thus superposed four color toner images on the intermediary transfer belt 5 are secondary-transferred in the secondary transfer nip N2 onto the transfer material P, conveyed in a direction indicated by an arrow K, by using a secondary transfer bias applied to the secondary transfer roller 7. The toner images are fixed during the passing of the transfer material after the secondary transfer through the fixing device 10, so that a full-color image is obtained. Thereafter, the transfer material P is discharged onto a sheet discharge tray 12 by a sheet discharging roller pair 11.

On the other hand, on the surface of the intermediary transfer belt 5 after the secondary transfer, secondary transfer residual toner which has not been transferred onto the transfer material P remains. The roller chargers 9*a* and 9*b* are located at the separation positions in which they are separated from the intermediary transfer belt 5 so as not to be contacted to the toner images on the intermediary transfer belt 5 during the primary transfer.

After the secondary transfer, the roller chargers 9*a* and 9*b* are moved from the separation positions in which they are spaced from the intermediary transfer belt 5 to the contact positions in which they are contacted to the intermediary transfer belt 5. The secondary transfer residual toner is supplied with the electric charge of an opposite polarity to the toner charge polarity, i.e., of the positive polarity by the roller chargers 9*a* and 9*b* to which a cleaning voltage has been applied, so that the residual toner is transferred back onto the photosensitive drum 1 by using the primary transfer voltage in the primary transfer nip N1. Here, a normal charge polarity of the toner is negative, and the cleaning voltage is the positive voltage.

The secondary transfer residual toner transferred back onto the photosensitive drum 1 is removed by the photosensitive drum cleaning blade 13 together with the primary transfer residual toner on the photosensitive drum 1 and is collected in the residual toner container 8. After the cleaning of the intermediary transfer belt 5 is performed, the roller chargers 9*a* and 9*b* are moved from the contact positions to the separation positions again with respect to the intermediary transfer belt 5. Thus, the apparatus main assembly in this embodiment is capable of executing a collecting mode, in order to collect the residual toner in the residual toner container 8, in which the residual toner charged by the first charging device and the second charging device is moved from the intermediary transfer member onto the image bearing member in the primary transfer nip and is collected by the collecting device.

(Contact and Separation Operation of Roller Charger)

A contact and separation operation, of the roller chargers 9*a* and 9*b*, which is a characteristic feature of the present invention will be described with reference to FIGS. 2 and 3.

Parts (a) to (d) of FIG. 2 are schematic views for illustrating a process from the start of the secondary transfer until the roller chargers 9*a* and 9*b* are contacted to the intermediary transfer belt 5. Referring to FIG. 2, on the intermediary transfer belt 5, there is an image transfer area 20 in which the superposed toner images of four colors were formed. The image transfer area 20 is a maximum area in which the toner images can be primary-transferred onto the intermediary transfer belt 5. Further, on the intermediary transfer belt 5, there is a non-image transfer area 22. The non-image transfer area is an area between a rear end of the image transfer area 20 and a front end of a subsequent image transfer area 20. In the non-image transfer area 22, the toner images are not primary-transferred during image formation.

In a stage shown in (a) of FIG. 2, in the primary transfer nip N1, the fourth color toner image is superposed. When the front end of the image transfer area 20 approaches the secondary transfer roller 7, the transfer material P which has been conveyed so as to perform front end registration enters the secondary transfer nip N2. Before the front end of the image transfer area 20 reaches the secondary transfer nip N2, the secondary transfer roller 7 is moved from the separation position shown in (a) of FIG. 2 to the contact position shown in (b) of FIG. 2 with respect to the intermediary transfer belt 5. The secondary transfer is effected by applying the secondary transfer voltage to the secondary transfer roller 7 at the contact position. On the intermediary transfer belt 5 having passed through the transfer nip N2, residual toner 21 which has not been completely secondary-transferred remains.

When the residual toner 21 approaches the roller charger 9*a*, as shown in (c) of FIG. 2, the roller charger 9*a* is moved from the separation position to the contact position relative to the intermediary transfer belt 5. To the roller charger 9*a* at the contact position, the cleaning voltage is applied, so that the residual toner is charged. At this time, in order to clean the entire image transfer area 20, before the front end portion of the area of the residual toner 21 (the image transfer area 20) reaches the nip formed between the roller charger 9*a* and the intermediary transfer belt 5, the contact of the roller charger 9*a* and the application of the voltage to the roller charger 9*a* are effected. That is, the contact of the roller charger 9*a* and the voltage application to the roller charger 9*a* are performed with timing when the roller charger 9*a* opposes the non-image transfer area 22.

Further, when the residual toner 21 approaches the roller charger 9*b*, as shown in (d) of FIG. 2, the roller charger 9*b* is moved from the separation position to the contact position relative to the intermediary transfer belt 5. To the roller charger 9*b* at the contact position, the cleaning voltage is applied, so that the residual toner is charged. At this time, in order to clean the entire image transfer area 20, before the front end portion of the area of the secondary transfer residual toner 21 (the image transfer area 20) reaches the nip formed between the roller charger 9*b* and the intermediary transfer belt 5, the contact of the roller charger 9*b* and the application of the (bias) voltage to the roller charger 9*b* are effected. That is, the contact of the roller charger 9*b* and the voltage application to the roller charger 9*b* are performed with timing when the roller charger 9*b* opposes the non-image transfer area 22.

That is, the roller chargers 9*a* and 9*b* are successively contacted to the intermediary transfer belt 5 from the upstream-side roller charger 9*a* with timing when the associated roller charger opposes the non-image transfer area 22. The roller chargers 9*a* and 9*b* are contacted in this order and therefore even when the non-image transfer area 22 on the intermediary transfer belt 5 is narrowed, both of the roller chargers 9*a* and 9*b* can be contacted to the intermediary transfer belt 5 in the non-image transfer area 22. It is further desirable that the two roller chargers 9*a* and 9*b* are contacted to the rotating intermediary transfer belt 5 at the same position of the intermediary transfer belt 5. This condition is represented by $t1=l/v$ wherein $t1$ is a time difference in contact timing of the two roller chargers 9*a* and 9*b*, $l$ is a distance between the two roller chargers 9*a* and 9*b*, and $v$ is a rotation speed of the intermediary transfer belt 5.

In this way, the residual toner 21 positively charged by the cleaning voltage is moved from the intermediary transfer belt 5 onto the photosensitive drum 1 by applying the positive voltage to the primary transfer device in the primary transfer nip N1 and is removed by the residual toner container 8, so that the cleaning is effected.

Here, the case where the collecting mode is executed in a continuous print job will be described. In the case of the continuous print job, the first-color toner image for a subsequent image has already been primary-transferred on the intermediary transfer belt 5 in the image transfer area 20. Therefore, after the area of the secondary transfer residual toner 21 has passed through the roller chargers 9*a* and 9*b*, the secondary transfer roller 7 and the roller chargers 9*a* and 9*b* are spaced from the intermediary transfer belt 5. With reference to FIG. 3, a process from the completion of the secondary transfer until the roller chargers 9*a* and 9*b* are separated will be described. In FIG. 3, the secondary transfer residual toner 21, a first-color toner image 23 for an image to be subsequently outputted and the non-image transfer area 22 are shown.

After the superposed four color toner images pass through the secondary transfer nip N2 of the secondary transfer roller 7, as shown in (a) of FIG. 3, the secondary transfer roller 7 is moved from the contact position to the separation position with respect to the intermediary transfer belt 5 in the non-image transfer area 22. At this time, in the case of the continuous print job, the first-color toner image 23 for the subsequent image is placed on the intermediary transfer belt 5 in the non-image transfer area 22. In the primary transfer nip N1, by using the primary transfer voltage, the toner image 23 for a subsequent transfer material is transferred from the photosensitive drum 1 onto the intermediary transfer belt 4 and at the same time the residual toner 21 on the intermediary transfer belt 5 is transferred back onto the photosensitive drum 1 and then is collected.

Then, when the secondary transfer residual toner 21 passed through the roller charger 9*a*, as shown in (b) of FIG. 3, the roller charger 9*a* is moved from the contact position to the separation position relative to the intermediary transfer belt 5. At this time, in order to clean the entire image transfer area 20, after the rear end portion of the area of the residual toner 21 (the image transfer area 20) reaches the nip formed between the roller charger 9*a* and the intermediary transfer belt 5, the separation of the roller charger 9*a* and stop of the application of the voltage to the roller charger 9*a* are effected. That is, the separation of the roller charger 9*a* and the stop of the voltage application to the roller charger 9*a* are performed with timing when the roller charger 9*a* opposes the non-image transfer area 22.

Further, when the secondary transfer residual toner 21 passes through the roller charger 9*b*, as shown in (c) of FIG. 3, the roller charger 9*b* is moved from the contact position to the separation position relative to the intermediary transfer belt 5. At this time, in order to clean the entire image transfer area 20, after the rear end portion of the area of the secondary transfer residual toner 21 (the image transfer area 20) reaches the nip formed between the roller charger 9*b* and the intermediary transfer belt 5, the separation of the roller charger 9*b* and stop of the application of the voltage to the roller charger 9*b* are effected. That is, the separation of the roller charger 9*b* and the stop of the voltage application to the roller charger 9*b* are performed with timing when the roller charger 9*b* opposes the non-image transfer area 22.

That is, the roller chargers 9*a* and 9*b* are successively separated from the intermediary transfer belt 5 from the upstream-side roller charger 9*a* with timing when the associated roller charger opposes the non-image transfer area 22 in which the residual toner 21 after the secondary transfer has already been charged. The roller chargers 9*a* and 9*b* are separated in this order and therefore even when the non-image transfer area 22 on the intermediary transfer belt 5 is narrowed, both of the roller chargers 9*a* and 9*b* can be separated from the intermediary transfer belt 5 in the non-image transfer area 22. It is further desirable that the two roller chargers 9*a* and 9*b* are separated from the rotating intermediary transfer belt 5 at the same position of the intermediary transfer belt 5. This condition is represented by $t2=l/v$ wherein $t2$ is a time difference in separation timing of the two roller chargers 9*a* and 9*b*, $l$ is a distance between the two roller chargers 9*a* and 9*b*, and $v$ is a rotation speed of the intermediary transfer belt 5. In FIG. 4, a time chart of operations of the secondary transfer roller 7 and the roller chargers 9*a* and 9*b* is shown.

As described above, according to this embodiment, even when the circumferential length of the intermediary transfer belt 5 is shortened, the two roller chargers 9*a* and 9*b* can reliably be contacted to and separated from the intermediary transfer belt 5 with timing when each of the roller chargers 9*a* and 9*b* opposes the non-image transfer area 22 of the intermediary transfer belt 5.

Next, a switching unit for switching the position of each of the first and second charging devices relative to the intermediary transfer member will be described. In this embodiment, the switching unit is a cam 25 provided on a shaft of the driving roller 14 which is an opposite roller with respect to the roller chargers 9*a* and 9*b*. The cam 25 is rotated by receiving a driving force from the apparatus main assembly. The rotation of the cam 25 is controlled by turning on and off an unshown solenoid by a signal from the apparatus main assembly. The timing of the turning on and off may also be judged on the basis of an image writing signal and an image writing completion signal from the exposure unit 3 generally used in the image forming process. As a result, each of the roller chargers 9*a* and 9*b* can be contacted to and separated from the intermediary transfer belt 5 with timing determined equidistantly from the front end or rear end of the image transfer area with respect to the rotational direction of the intermediary transfer belt 5. Further, a boundary between the image transfer area and the non-image transfer area on the intermediary transfer belt 5 may also be judged on the basis of a boundary position read by a test pattern detecting device 17 shown in FIG. 1. As a result, the roller chargers 9*a* and 9*b* can be contacted to and separated from the intermediary transfer belt 5 with timing determined equidistantly from the boundary position on the basis of the boundary position. Thus, the roller chargers 9*a* and 9*b* can be contacted to and separated from the intermediary transfer belt 5 with high accuracy at the same position of the intermediary transfer belt 5. Further, when the boundary position is judged by the test pattern detecting device 17, even in the case where there is a minute variation in rotational speed of the intermediary transfer belt 5, the roller chargers 9*a* and 9*b* can be contacted to and separated from the intermediary transfer belt 5 with high accuracy at the same position of the intermediary transfer belt 5.

The cam 25 includes a contact portion where the cam 25 is oppositely contacted to the roller chargers 9*a* and 9*b* and includes a non-contact portion where the cam 25 is not oppositely contacted to the roller chargers 9*a* and 9*b*. As shown in FIG. 5, when the cam 25 is rotated, bearings 26*a* and 26*b* of the roller chargers 9*a* and 9*b* are contacted to the contact portion of the cam 25, so that the rotation is converted into up-and-down motion. When the contact portion of the cam 25 and the bearings 26*a* and 26*b* are contacted to each other, the bearings 26*a* and 26*b* are moved, so that the roller chargers 9*a* and 9*b* are moved to the separation position. When the opposing portion of the bearings is switched from the contact portion to the non-contact portion by the rotation of the cam 25, the bearings are moved, so that the roller chargers are moved to the contact portion.

Incidentally, in this embodiment, the cam 25 is disposed coaxially with the driving roller 14, so that both of the roller chargers 9*a* and 9*b* are operated by rotating the same cam 25. As a result, a constitution can be simplified. Up-and-down timing of the roller chargers 9*a* and 9*b* is optimized by designing the rotational speed of the cam 25 so as to be an optimum value by timing the rotational speed of the cam 25 to the rotational speed of the intermediary transfer belt 5. Incidentally, a similar cam may also be provided on an opposite side of the driving roller 14 with respect to the axial direction of the driving roller 14.

FIG. 6 shows a switching unit in a comparative embodiment. In FIG. 6, a reference numeral 105 represents the intermediary transfer belt and a reference numeral 120 represents the switching unit in the comparative embodiment. Further, in FIG. 6, a first charging device 123 located on the upstream side with respect to the rotational direction, a bearing member 124 for the first charging device 123, a second charging device 121 located on the downstream side with respect to the rotational direction, and a bearing member 122 for the second charging device 121 are shown.

The bearing member 122 is moved upward and downward by the rotation of the cam 120 in the direction indicated by an arrow, and the bearing member 122 moves the bearing member 124 upward and downward while supporting the bearing member 124. Part (a) of FIG. 6 illustrates a separation operation and (b) of FIG. 6 illustrates a contact operation. According to the constitution shown in FIG. 6, the first charging device and the second charging device are contacted to the intermediary transfer belt in this order during the contact operation, and the second charging device and the first charging device are separated from the intermediary transfer belt in this order during the separation operation. Therefore, by the switching unit in the comparative embodiment, the object of the present invention cannot be achieved.

Second Embodiment (Contact and Separation Operation of Roller Charger)

In this embodiment, a basic portion of a constitution of an image forming apparatus is substantially the same as that in First Embodiment. Therefore, the same portions will be omitted from description and different portions will be described.

A contact and separation operation of the roller chargers 9*a* and 9*b*, which is a characteristic feature of the present invention, will be described with reference to FIGS. 7 and 8.

Parts (a) to (d) of FIG. 7 are schematic views for illustrating a process from the start of the secondary transfer until the roller chargers 9*a* and 9*b* are moved from the separation positions to the contact positions. Referring to FIG. 7, an image transfer area 30, in which the superposed toner images of four colors were formed on the intermediary transfer belt 5, and a non-image transfer area 32 are shown.

In a stage shown in (a) of FIG. 7, in the primary transfer nip N1, the fourth color toner image is superposed. As shown in FIG. 7(*a*), there is a point PA1 at the front end of the image transfer area 30. When the point PA1 approaches the secondary transfer roller 7, before the point PA1 reaches the secondary transfer nip N2, the secondary transfer roller 7 is moved from the separation position shown in (a) of FIG. 7 to the contact position shown in (b) of FIG. 7 relative to the intermediary transfer belt 5. The secondary transfer is effected by applying the secondary transfer voltage to the secondary transfer roller 7. On the intermediary transfer belt 5 having passed through the transfer nip N2, residual toner 31 which has not been completely secondary-transferred remains.

When the front end of the residual toner 31, i.e., the point PA1 approaches the roller charger 9*a*, as shown in (c) of FIG. 7, the roller charger 9*a* is moved from the separation position to the contact position relative to the intermediary transfer belt 5, so that the residual toner is charged. At this time, in order to clean the entire image transfer area 30, before the point PA1 reaches the nip formed between the roller charger 9*a* and the intermediary transfer belt 5, the movement of the roller charger 9*a* to the contact position and the application of the voltage to the roller charger 9*a* are effected. In (c) of FIG. 7, a point at which the roller charger 9*a* is contacted to the intermediary transfer belt 5 is PB1.

Further, when the residual toner 31 approaches the roller charger 9*b*, as shown in (d) of FIG. 7, the roller charger 9*b* is moved from the separation position to the contact position relative to the intermediary transfer belt 5, so that the residual toner is charged. At this time, in order to effect cleaning with reliability, before the point PB1, which is the front end portion of a cleaning area by the roller charger 9*a*, reaches the nip formed between the roller charger 9*b* and the intermediary transfer belt 5, the contact of the roller charger 9*b* and the application of the (bias) voltage to the roller charger 9*b* are effected. In (d) of FIG. 7, a point at which the roller charger 9*b* is contacted to the intermediary transfer belt 5 is PC1. Incidentally, all the points PA1, PB1 and PC1 are within the non-image transfer area 32 on the intermediary transfer belt 5.

In the above-described order and with the above-described toner, the roller chargers 9*a* and 9*b* are contacted to the intermediary transfer belt 5. Therefore even when the non-image transfer area 32 on the intermediary transfer belt 5 is narrow, it is possible to compatibly realize the contact of both of the roller chargers 9*a* and 9*b* with the intermediary transfer belt 5 in the non-image transfer area 22 and the cleaning with reliability. This condition is represented by $t3<l/v$ wherein t3 is a time difference in contact timing of the two roller chargers 9*a* and 9*b*, l is a distance between the two roller chargers 9*a* and 9*b*, and *v* is a rotation speed of the intermediary transfer belt 5.

In this way, the cleaning, i.e., the removal of the secondary transfer residual toner, is effected.

Here, in the case of the continuous print job, the first-color toner image for a subsequent image is placed on the intermediary transfer belt 5 in the image transfer area 30. Therefore, after the area of the residual toner 31 has passed through the roller chargers 9*a* and 9*b*, the secondary transfer roller 7 and the roller chargers 9*a* and 9*b* are spaced from the intermediary transfer belt 5. With reference to FIG. 8, a process from the start of the secondary transfer until the roller chargers 9*a* and 9*b* are separated will be described. In FIG. 8, the secondary transfer residual toner 21, a first-color toner image 33 for an image to be subsequently outputted and the non-image transfer area 32 are shown. Here, an area of the secondary transfer residual toner 31 ranges from the non-image transfer area 32 to the primary transfer nip N1 with respect to the rotational direction of the intermediary transfer belt 5. Further, an area of the toner image 33 ranges from the primary transfer nip N1 to the non-image transfer area 32 with respect to the rotational direction of the intermediary transfer belt 5.

The rear end of the image transfer area is a point PA2.

After the point PA2 passes through the secondary transfer nip N2 of the secondary transfer roller 7, as shown in (a) of FIG. 8, the secondary transfer roller 7 is moved from the contact position to the separation position with respect to the intermediary transfer belt 5 in the non-image transfer area 32. At this time, in the case of the continuous print job, the first-color toner image 33 for the subsequent image is placed on the intermediary transfer belt 5 in the non-image transfer area 32. In the primary transfer nip N1, by using the primary transfer voltage, the toner image 23 is transferred from the photosensitive drum 1 onto the intermediary transfer belt 4 and at the same time the residual toner 31 on the intermediary transfer belt 5 is transferred back onto the photosensitive drum 1 and then is collected.

When the front end of the secondary transfer residual toner 31, i.e., the point PA1, approaches the roller charger 9*a*, as shown in (b) of FIG. 8, the roller charger 9*a* is moved from the contact position to the separation position relative to the intermediary transfer belt 5. In (b) of FIG. 8, a point at which the roller charger 9*a* is separated from the intermediary transfer belt 5 is PB2.

Further, when the secondary transfer residual toner 31 passes through the roller charger 9*b*, as shown in (c) of FIG. 8, the roller charger 9*b* is moved from the contact position to the separation position relative to the intermediary transfer belt 5. At this time, in order to effect cleaning with reliability, before the point PB2 passes through the nip formed between the roller charger 9*b* and the intermediary transfer belt 5, the separation of the roller charger 9*b* and stop of the application of the (bias) voltage to the roller charger 9*b* are effected. In (d) of FIG. 7, a point at which the roller charger 9*b* is separated from the intermediary transfer belt 5 is PC2. Incidentally, all the points PA2, PB2 and PC2 are within the non-image transfer area 32 on the intermediary transfer belt 5.

In the above-described order and with the above-described toner, the roller chargers 9*a* and 9*b* are moved from the contact position to the separation position. Therefore even when the non-image transfer area 32 on the intermediary transfer belt 5 is narrow, it is possible to compatibly realize the separation of both of the roller chargers 9*a* and 9*b* with the intermediary transfer belt 5 in the non-image transfer area 22 and the cleaning with reliability. This condition is represented by $t4>l/v$ wherein t4 is a time difference in separation timing of the two roller chargers 9*a* and 9*b*, l is a distance between the two roller chargers 9*a* and 9*b*, and v is a rotation speed of the intermediary transfer belt 5.

The conditions described above are summarized as follows. A length of the image transfer area on the intermediary transfer belt 5 with respect to the rotational direction of the intermediary transfer belt 5 (referred to as a total image transfer area length) is taken as D. Further, a length of an area in which the secondary transfer roller 7 is contacted to the intermediary transfer belt 5 with respect to the rotational direction of the intermediary transfer belt 5 (referred to as a total transfer area length) is taken as TR. A length of a total area in which the roller charger 9*a* is contacted to the intermediary transfer belt 5 with respect to the rotational direction of the intermediary transfer belt 5 is taken as C1. A length of a total area in which the roller charger 9*b* is contacted to the intermediary transfer belt 5 with respect to the rotational direction of the intermediary transfer belt 5 is taken as C2. Incidentally, the area in which the secondary transfer roller or the roller charger is contacted to the intermediary transfer belt 5 is referred to as the total area. That is, the total area ranges from start of the contact of the secondary transfer roller or the roller charger with the intermediary transfer belt 5 until the secondary transfer roller or the roller charger is separated from the intermediary transfer belt 5. These lengths D, TR, C1 and C2 satisfy the relationship of: $D<TR<C1<C2$. This relationship is shown in FIG. 9. FIG. 9 is a schematic view in which the intermediary transfer belt 5 is developed and schematically illustrates a positional relationship among the length (areas) D, TR, C1 and C2.

As shown in FIG. 9, the total transfer area length TR completely includes the total image transfer area length D. Further, the total area length C1 in which the roller charger 9*a* contacted to the intermediary transfer belt 5 completely includes the total image transfer area length D. Further, the total area length C2 in which the roller charger 9*b* is contacted to the intermediary transfer belt 5 completely includes the total area length C1. That is, the total areas in which the two roller chargers are contacted to the intermediary transfer belt 5 satisfy such a relationship that the total area in which the roller charger 9*b* disposed on the downstream side is contacted to the intermediary transfer belt 5 includes the total area in which the roller charger 9*a* disposed on the upstream side of the roller charger 9*b* is contacted to the intermediary transfer belt 5.

In this way, the residual toner 31 on the intermediary transfer belt 5 can be removed with reliability. Further, also in this case, even when the circumferential length of the intermediary transfer belt 5 is shortened, the two roller chargers 9*a* and 9*b* can reliably be contacted to and separated from the intermediary transfer belt 5 with timing when each of the roller chargers 9*a* and 9*b* opposes the non-image transfer area 32 of the intermediary transfer belt 5. Further, the length C2 of the total area in which the roller charger 9*b* closer to the primary transfer portion is contacted to the intermediary transfer belt 5 is longest, so that the residual toner on the intermediary transfer belt can be electrically charged with reliability.

In this embodiment, the roller charger is used as the charging device, but may also be replaced with a brush charger. Particularly, in the case where a brush member fixed with respect to rotational motion of the intermediary transfer belt is used, a brush portion of the brush member is contacted to the residual toner and thus breaks a lamination state of the residual toner. When the residual toner is charged in the broken state, a charging efficiency is enhanced, so that the toner image is liable to be moved from the intermediary transfer belt onto the image bearing member in the primary transfer nip.

Therefore, it would be considered that both of the first and second charging devices employ the brush charger. However, the charging efficiency of the charging device in the roller shape is higher than that of the charging device in the brush shape and thus it would be considered that the roller charger is used as the first charging device and the brush charger is used as the second charging device.

In this constitution, when the constitution in this embodiment is employed, the toner can be charged with reliability by the brush charger which has the good charging efficiency and is the second charging device, so that it becomes possible to collect the residual toner efficiently.

In this embodiment, as the mechanism for moving the roller chargers 9*a* and 9*b* between the contact position and the separation position relative to the intermediary transfer belt 5, a switching unit similar to that used in First Embodiment is employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 008360/2010 filed Jan. 18, 2010, which is hereby incorporated by reference.

What is claimed is:

1. An image forming apparatus comprising:

an image bearing member for bearing a toner image;

a rotatable intermediary endless belt;

a plurality of stretching rollers for stretching said intermediary endless belt;

a primary transfer device, which forms a primary transfer nip between said image bearing member and said intermediary endless belt, for primary-transferring the toner image from said image bearing member onto said intermediary endless belt at the primary transfer nip;

a collecting device for collecting the toner on said image bearing member;

a secondary transfer device for secondary-transferring the toner image from said intermediary endless belt onto a transfer material;

a first charging device, movable between a first contact position in which said first charging device is contacted to said intermediary endless belt and a first separation position in which said first charging device is separated from said intermediary endless belt, for electrically charging residual toner remaining on said intermediary endless belt at the first contact position;

a second charging device, movable between a second contact position in which said second charging device is contacted to said intermediary endless belt and a second separation position in which said second charging device is separated from said intermediary endless belt, for electrically charging the residual toner remaining on said intermediary endless belt at the second contact position, wherein said second charging device is provided downstream of said first charging device with respect to a rotational direction of said intermediary endless belt; and a switching unit for switching positions of said first charging device relative to said intermediary endless belt and positions of said second charging device relative to said intermediary endless belt, wherein said image forming apparatus is capable of executing a collecting mode in which the residual toner electrically charged by said first and second charging devices is moved from said intermediary endless belt to said image bearing member in at the primary transfer nip and then is collected by said collecting device, wherein said switching unit moves, when said first and second charging devices are to be moved from the first and second separation positions to the first and second contact positions, said first charging device from the first separation position to the first contact position at a timing when said first charging device opposes a non-image transfer area adjacent to an image transfer area and then moves said second charging device from the second separation position to the second contact position at a timing when said second charging device opposes the non-image transfer area, wherein said switching unit moves, when said first and second charging devices are to be moved from the first and second contact positions to the first and second separation positions, said first charging device from the first contact position to the first separation position at a timing when said first charging device opposes the non-image transfer area and then moves said second charging device from the second contact position to the second separation position at a timing when said second charging device opposes the non-image transfer area, wherein one of the stretching rollers is an opposing roller which opposes said first and second charging devices through said intermediary endless belt, and wherein said switching unit is a cam provided at the opposing roller.

2. An apparatus according to claim 1, wherein the opposing roller is a driving roller for rotating said intermediary endless belt, and wherein the cam is rotated by rotation of the driving roller.

3. An apparatus according to claim 2, wherein the cam includes a contact portion where the cam is contactable to said first and second charging devices and includes a non-contact portion where the cam does not contact said first and second charging devices, and wherein the cam is rotated to cause the contact portion to be contacted to said first charging device thereby to move said first charging device from the first contact position to the first separation position, and then is further rotated to cause the contact portion to be contacted to said second charging device thereby to move said second charging device from the second contact position to the second separation position.

4. An apparatus according to claim 1, wherein a total area in which said first charging device is contacted to said intermediary endless belt is completely within a total area in which said second charging device is contacted to said intermediary endless belt.

5. An apparatus according to claim 1, further comprising a detecting device for detecting a test toner image formed on said intermediary endless belt, wherein said detecting device detects a boundary position between the image transfer area and the non-image transfer area with respect to a rotational direction of said intermediary endless belt, and wherein said switching unit moves said first and second charging devices toward and away from said intermediary endless belt at a timing determined on the basis of the boundary position detected by said detecting device.

6. An image forming apparatus comprising:

an image bearing member for bearing a toner image;

a rotatable intermediary endless belt for secondary-transferring the toner image, primary-transferred from said image bearing member at a primary transfer nip, onto a recording material at a secondary transfer nip;

a plurality of stretching rollers for stretching said intermediary endless belt; and a first charging device and a second charging device which are contactable to and separable from said intermediary endless belt and which are capable of electrically charging a toner remaining on said intermediary endless belt, wherein said first charging device is provided upstream of said second charging device with respect to a rotational direction of said intermediary endless belt, wherein one of said stretching rollers is an opposing roller which opposes said first and second charging devices through said intermediary endless belt, wherein said opposing roller includes a cam, wherein when said first and second charging devices separated from said intermediary endless belt are to be contacted to said intermediary endless belt, said cam brings said first charging device into contact with said intermediary endless belt and thereafter brings said second charging device into contact with said intermediary endless belt, and wherein when said first and second charging devices contacted to said intermediary endless belt are to be separated from said intermediary endless belt, said cam separates said first charging device from said intermediary endless belt and thereafter separates said second charging device from said intermediary endless belt.

7. An apparatus according to claim 6, wherein said cam brings said first and second charging devices into contact with said intermediary endless belt at a timing when said first and second charging devices oppose an image forming area on said intermediary endless belt onto which the toner image is to be primary-transferred from said image bearing member and oppose a non-image forming area formed between the image forming area and a subsequent image forming area.

8. An apparatus according to claim 7, wherein said cam separates said first and second charging devices from said intermediary endless belt at a timing when said first and second charging devices oppose an image forming area on said intermediary endless belt onto which the toner image is to be primary-transferred from said image bearing member and oppose a non-image forming area formed between the image forming area and a subsequent image forming area.

9. An apparatus according to claim 6, further comprising:

a collecting device for collecting a residual toner from said image bearing member, wherein said image forming apparatus is capable of executing a collecting mode in which the residual toner electrically charged by said first and second charging devices is moved from said endless belt to said image bearing member at the primary transfer nip and then is collected by said collecting device.

10. An apparatus according to claim 9, wherein at the primary transfer nip, the residual toner is moved from said intermediary endless belt to said image bearing member, and at the same time the toner image is primary-transferred from said image bearing member onto said intermediary endless belt.

11. An apparatus according to claim 6, wherein the opposing roller is a driving roller for rotating said endless belt, and wherein the cam is rotated by rotation of the driving roller.

12. An apparatus according to claim 6, wherein the cam includes a contact portion where the cam is contactable to said first and second charging devices and includes a non-contact portion where the cam does not contact said first and second charging devices.

* * * * *